United States Patent [19]

Stewart

[11] Patent Number: 4,588,191

[45] Date of Patent: May 13, 1986

[54] GOLF CLUB WEIGHTING DEVICE

[76] Inventor: Donald R. Stewart, 2565 Yellow Springs Rd., Springfield, Ohio 45506

[21] Appl. No.: 675,141

[22] Filed: Nov. 27, 1984

Related U.S. Application Data

[63] Continuation-in-part of Ser. No. 462,412, Mar. 1, 1983, abandoned.

[51] Int. Cl.[4] ..... A63B 69/36

[52] U.S. Cl. ..... 273/194 B; 273/DIG. 30

[58] Field of Search ..... 273/189 A, 189 R, 194 B, 273/194 R, 194 A, 26 B, 193 A, 1 B, 186 A

[56] References Cited

U.S. PATENT DOCUMENTS

| | | | |
|---|---|---|---|
| 2,608,409 | 8/1952 | Pinkerton | 273/35 |
| 3,490,768 | 1/1970 | Archer | 273/32 |
| 3,575,419 | 4/1971 | Davis | 273/186 |
| 3,716,239 | 2/1973 | Goudreau | 273/194 A |
| 3,740,053 | 6/1973 | Eiger | 273/194 B |
| 4,273,130 | 6/1981 | Simpson | 273/189 A |
| 4,364,560 | 12/1982 | Gemmel | 273/1 B |
| 4,502,688 | 3/1985 | Papp | 273/189 A |

FOREIGN PATENT DOCUMENTS

| | | | |
|---|---|---|---|
| 472237 | 9/1937 | United Kingdom | 273/194 R |

*Primary Examiner*—George J. Marlo

*Attorney, Agent, or Firm*—Dybvig & Dybvig

[57] ABSTRACT

A unitary, self-contained, self-clamping golf club weight includes a pair of substantially identical clamp jaws each made from high density material and formed as a generally hemispherical sector having a generally planar surface with an arcuate, shaft-receiving groove extending axially completely from the top to the bottom thereof. The jaws are coated with an elastomeric, non-slip material. A flexible cinch strap extends around the girth of the jaws for holding them together along adjacent side edges. In use, the opposite jaw edges are drawn toward one another by pulling on the cinch strap at which time the grooves are clamped tightly against a golf club shaft. The adjacent edges of the jaws are so contoured that they may move with respect to one another as the cinch strap is drawn tight so as to permit the jaws to be drawn into clamping engagement with said shaft over the entire length of the grooves. In the preferred embodiment, the jaws are also held together by a spring steel strap. Instructions for using the weight to improve a golfer's swing and dimensions of the weight are also included.

10 Claims, 9 Drawing Figures

GOLF CLUB WEIGHTING DEVICE

CROSS-REFERENCE TO RELATED APPLICATION

This is a continuation-in-part of application Ser. No. 462,412, filed Mar. 1, 1983, for "Golfer's Rhythm Builder," now abandoned.

SUMMARY OF THE INVENTION

This invention relates to a unitary exercise or practice weight adapted to be quickly and easily self-clamped onto a tapered golf club shaft so that one may mount the weight at any location along the length of the shaft. A golfer using this device may place the weight of this invention at a location on the shaft suitable to the golfer's individual swing and practice to develop a balanced and rhythmic swing for distance and accuracy. Although the primary purpose of this invention is for golf swing training, the invention may be useful for developing powerful, rhythmic swings with shafts used in other sports.

Golfers often practice by swinging two or more golf clubs at a time for added swing weight to loosen their muscles and in an effort to develop a rhythmic golf swing. However, two clubs are unbalanced and hard to hold. Various types of weight devices have been proposed for the same purpose. Some of these slip over the shaft of a wood and frictionally engage around the tapered stub at the top of the head. These add weight only to the area of the head of the wood and occassionally may become disengaged from the head during the backswing. Moreover, they are not suitable for use on irons because of the differences in the shape of the heads of irons. This type of device is shown in U.S. Pat. No. 2,608,409, granted to D. F. Pinkerton of Aug. 2, 1952, and U.S. Pat. No. 3,716,239, granted to N. G. Goudreau on Feb. 13, 1973. U.S. Pat. No. 3,740,053, granted to W. H. Eiger on June 10, 1973, discloses a golf club weight comprising a molded elastomeric body clamped around a club shaft located at the balance point of the golf club.

An object of this invention is to provide a golf club weight that is easily and quickly securely mounted on and removed from any club shaft, whether straight or tapered. A further object of this invention is to provide a golf club weight that is unitary or self-contained and therefore does not require assembly and disassembly of component parts. Still another object of this invention is to provide such a weight that is compact yet quite heavy.

A golf club weight in accordance with this invention comprises a pair of clamping jaws, each made from a high specific gravity material, preferably lead, that provides substantial weight with a minimum of bulk. Materials of lesser specific gravity may be used for those desiring less weight. The jaws have generally planar mutually confronting surfaces that are provided with shaft-receiving, arcuate grooves extending from the top to the bottom thereof. The grooves are sufficiently shallow to insure that any part of a club shaft located therebetween will be gripped. The clamp jaws are coated over their entire surfaces with an elastomeric material which acts as a non-slip surface between the jaws and the club shaft.

In the presently preferred embodiment, the jaws are held together along adjacent edges by a spring steel strip which is so formed as to hold the opposite edges of the jaws apart to form a slot opening to the shaft-receiving grooves. The spring steel strip provides a "loose" hinge and clamping means which permits the jaws to spread apart to enable the weight to be easily assembled onto a club shaft. Also, it permits the jaws to pivot slightly one to another along their adjacent edges to accommodate tapered shafts. When the shaft is surrounded by the arcuate grooves, the jaws under the influence of the spring steel strip snap closed, centering and holding the weight on the club shaft. In a modification, the spring steel strip is omitted.

Whether or not a spring steel strip is used, a cinching strap, preferably having a hook and loop fastener, such as VELCRO ® surrounds the girth of the clamp jaws and is used to create substantial gripping pressure between the weight and the club shaft. The cinching strap safely prevents the weight from becoming free of the shaft and the gripping pressure is such that the weight is securely held at the desired location along the shaft.

The ease of attachment and detachment of the unitary weight of this invention is very important as the weight must be adjusted up or down the club shaft so that golfers may find their optimum point on each club with which they are practicing, from driver to putter. Also, it should be convenient to be removed from the pocket or bag and applied to a club shaft for a few practice swings during the round if rhythm is lost.

Other objects and advantages will become apparent from the following description and the drawings.

DESCRIPTION OF THE PREFERRED EMBODIMENTS

Figure 1:
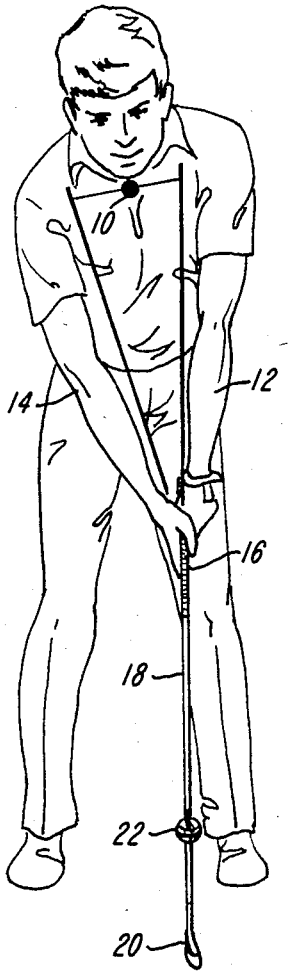
FIG. 1 is a front elevational view of a golfer using a golf club weight of this invention.

Referring to FIG. 1, a golf club swing is a simple pendulum swing wherein the pivotal point of suspension is at 10, a point just above the golfer's sternum, the pendulum shaft is a combination of the golfer's hands and arms 12 and 14, the grip 16 and the club shaft 18. The pendulum weight is primarily formed by the club head 20. In accordance with this invention, the pendulum weight may advantageously be substantially increased by the addition of a unitary or self-contained golf club weight 22 which can be easily and securely mounted on any portion of the club shaft 18 between the head 20 and the grip 16. It is easily located at any point on the shaft 18 and should be positioned and repositioned until the golfer feels "fluid-flow" of body with swing. The weight 22 is thus positioned for proper balance of the swing, not just the club, and the point on the shaft 18 for proper attachment of the weight 22 depends on the golfer's build and the club being used. The golfer practices with the weight device in this position on the shaft 18 until a well balanced, rhythmic swing is developed.

With reference to FIGS. 2 through 6, the unitary weight 22 of this invention comprises two substantially identical clamp jaws 24 and 26 which may be metal castings, preferably consisting of a high specific gravity material, such as lead, shaped in the form of substantially hemispherical sectors. The jaws 24 and 26 have generally planar confronting surfaces 28 and 30, respectively, having centrally located shaft-receiving grooves 32 and 34, respectively, extending axially from the top to the bottom of the jaws 24 and 26.

A generally C-shaped spring steel band or strip 40 having its ends formed as inwardly extending flanges 42 and 44 is assembled around the girth of the jaws 24 and 26. So that the outer contour of the weight 22 will be relatively smooth, the outwardly facing surfaces of the jaws 24 and 26 have centrally located, peripherally extending recesses 46 and 48, respectively, that receive the circular portion of the spring band 40. Also, the peripheral recesses 46 and 48 join to radial recesses 50 and 52, respectively, that receive the spring flanges 42 and 44, respectively. The arrangement and constructon of the spring band 40 and the jaws 24 and 26 is such that the jaws 24 and 26 are held in side-by-side relation, and come together at their larger diameter points above and below the peripheral recesses 46 and 48 along adjacent side edges as indicated at 54; and the opposite edges of the jaws are held spaced from one another to form a tapered opening 56 communicating with the area bounded by the shaft-receiving grooves 32 and 34. The generally hemispherical shape of the jaws 24 and 26 creates a one or two point contact hinge with minimum contact resistance at 54, and the spring band 40 allows the tapered opening 56 to expand for different diameter shafts.

Figure 5:
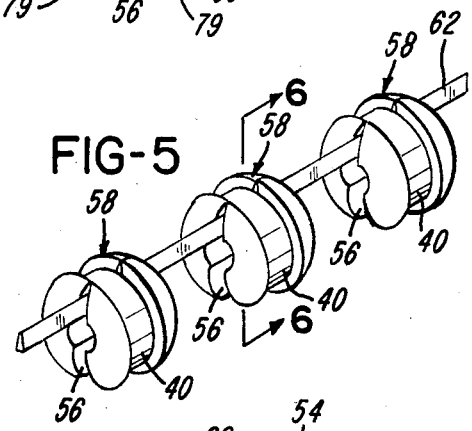
FIG. 5 is a perspective view illustrating a step in the manufacture of weights of the type illustrated in FIGS. 1 through 4.
Figure 6:
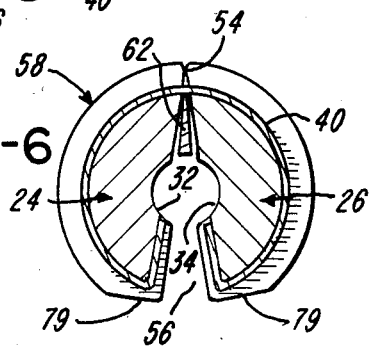
FIG. 6 is a cross-sectional view of the parts of FIG. 5 taken along line 6—6 thereof.

To produce the completed weight 22, a sub-assembly 58 is first produced comprising the two jaws 24 and 26 and the spring band 40, the band 40 being sufficiently flexible to enable these parts to be assembled together. Thereafter, the sub-assembly 58 is provided with a coating 60 of elastomeric material, a rubberized vinyl composition being suitable for this purpose. The coating may be accomplished in various ways, but the method described in connection with FIGS. 5 and 6 is preferred. There it will be seen that an elongate hanger or dipping rod 62 having a cross-section in the form of a truncated wedge is inserted through the openings 56 of plural sub-assemblies 58, with its apex located at the closely adjacent edges of the base surfaces of the peripheral recesses 46 and 48. The dipping rod 62 supports the sub-assemblies 58 while they are lowered into a vat (not shown) of the elastomeric coating material in a liquid state. The rod 58 is then withdrawn from the liquid material, carrying the freshly coated sub-assemblies 58 with it, and the coating 60 is then permitted to cure. During the dipping operation, a web 64 of the coating 60 is formed between the dipping rod 62 and the opening formed between the two shaft-receiving grooves 32 and 34. When the dipping rod 62 is removed after the coating operation, it leaves a void or chamber 66 adjacent the web 64 that extends parallel to and adjacent the shaft-receiving recesses 32 and 34. Any excess coating material is removed by trimming off after the dipping rod 62 is removed. Since the coating operation may be entirely conventional, it is not described in detail herein. Those familiar with the art will be aware that the sub-assemblies would be heated before dipping and then heated again after dipping to promote the curing of the coating. Also, the coating operation could be accomplished by spraying as an alternative to dipping.

Figure 2:
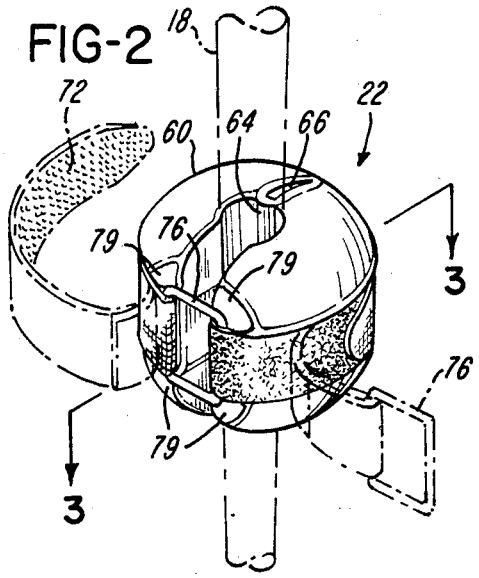
FIG. 2 is a perspective view of the golf club weight of FIG. 1 shown applied to a portion of a shaft ilustrated by phantom lines and also including, by phantom lines, a cinch strap spread open.
Figure 3:
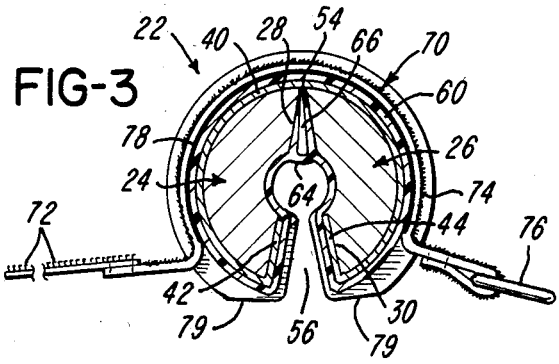
FIG. 3 is a cross-sectional view of the weight taken along line 3—3 of FIG. 2.
Figure 4:
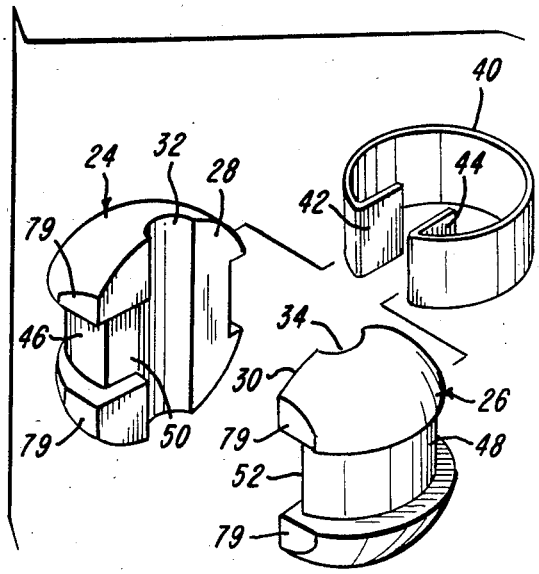
FIG. 4 is an exploded perspective view of three components forming a sub-assembly of the weight of FIG. 1.

After coating, a flexible cinching strap 70, shown in FIGS. 2 and 3, is connected by any suitable adhesive into encircling relation to the coated sub-assembly 58. The cinching strap 70 preferably has a VELCRO® fastener on its outside surface, such as the illustrated hook and loop fabric material with its interengaging multitude of hooks 72 and looped pile 74. Such a fastener may accomodate infinite variations in club shaft diameters. One end of the strap 70 holds cinch ring 76. As apparent, the free end of the strap 70 with the hooks 72 may be inserted through the cinch ring 76 and reversely folded so that the hooks 72 are engaged with the looped pile 74. The connection of the strap 70 to the coating 60 on the sub-assembly 58 is preferably accomplished by an adhesive coating 78 on the inner face of the strap 70. No adhesive is provided near the ends of the strap 70 so that these ends may be conveniently spread apart, as indicated by phantom lines in FIG. 2, and are therefore easily manipulated. Straps such as strap 70 with adhesive applied are commercially available under the trademarks VST® and VELSTRAP® from VELCRO USA Inc., 521 Fifth Avenue, New York, N.Y. 10175. The upper and lower surfaces of the jaws 24 and 26 adjacent the opening 56 are preferably formed as flats 79 to accomodate the cinch ring 76.

The weight 22 is adapted to be mounted on either straight or tapered (including stepped) club shafts having different diameters and grippingly engage the shaft along the entire length of the coated grooves 32 and 34. To this end, the spring band 40 and the cinch strap 70 are made somewhat narrower than the recesses 46 and 48, and have some degree of flexibility to permit the two jaws 24 and 26 to pivot one relative to the other about either one or both of their mutual contact points at 54 and thereby enable the weight 22 to conform to the shape of the club shaft. Since the pressure exerted by the spring 40 and the strap 70 is centered axially around the girth of the jaws 24 and 26, a uniform pressure is created between the coating 60 and the shaft 18 along the the entire length of the shaft-receiving grooves 32 and 34. Accordingly, the weight 22 of this invention may be securely connected to all known conventional shafts, whether straight or tapered.

With reference to FIG. 2, to apply the weight 22 to the shaft 18, the golfer aligns the opening 56 with the shaft 18 and then simply pushes the weight 22 onto the shaft 18 until the shaft 18 is received between the grooves 32 and 34. Thereafter, the free end of the strap 70 is threaded through the cinch ring 76 and then drawn tight and meshed with its mating surface around the device's periphery. Removal is in reverse order.

In use, it is recommend that the golfer start with an easy three-quarter swing with feet close together. The weight 22 is located on the shaft 18 at the point where the least imbalance and awkwardness is experienced by the golfer when swinging. This location may be termed the golfer's "swing-center" for that particular golfer's build and the club being used. The golfer practices with the weight 22 in this position on the shaft 18, gradually increasing the width of stance and the length of swing. the weight 22 will securely remain in this position because of the clamping engagement between the club shaft and the entire length of the coated groove 32 and 34. (The web 64 may also increase the resistance to movement of the weight 22 along the golf club shaft because of the increased area of frictional contact between the club shaft and the weight 22 provided thereby.) With practice, the golfer may gradually find that the swing center moves down the shaft 18, but care should be taken to maintain the feel of a "well-oiled", balanced, fluid swing. The golfer practices the adjustable compound pendulum swing until it is implanted in the subconscious mind so it will be retained when the device is removed and the simple pendulum swing is used for play. The added weight on the shaft exaggerates any lack of cooperation of body elements flowing with the swing, which is felt by the golfer as imbalance and awkwardness, and must be corrected for a rhythmical swing.

Although the size and weight of the weight 22 may be changed to suit the golfer's exercise needs, the preferred device has a total weight on the order of ten ounces. This is a substantial weight that practically forces the golfer into a good swing rhythm. Such a weight may be made having cast lead jaws 24 and 26 having a height of approximately 1¾ inches and a maximum depth of approximately 11/16 inch. The channels 46 and 48 have a depth of 3/32 inch. Most importantly, the axial grooves 32 and 34 may have a depth on the order of ⅛ inch and should not have a substantially greater depth so that the weight 22 may be self-clamped along any part of the length of the shaft of essentially all commercially available golf clubs. The coating 60 may be on the order of 1/16 inch thick and preferably has a durometer of approximately seventy.

Figure 7:
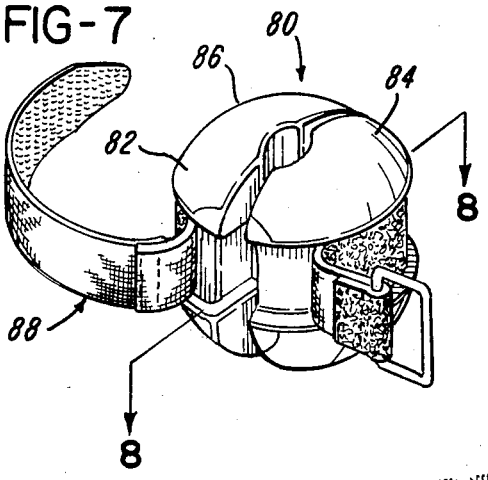
FIG. 7 is a perspective view of another embodiment of a golf club weight in accordance with this invention.
Figure 8:
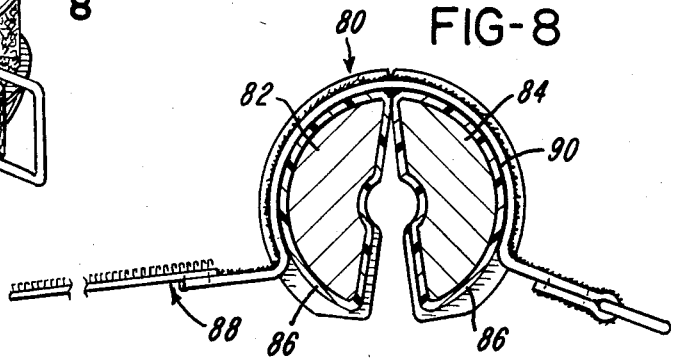
FIG. 8 is a cross-sectional view of the weight of FIG. 7 taken along line 8—8 thereof.
Figure 9:
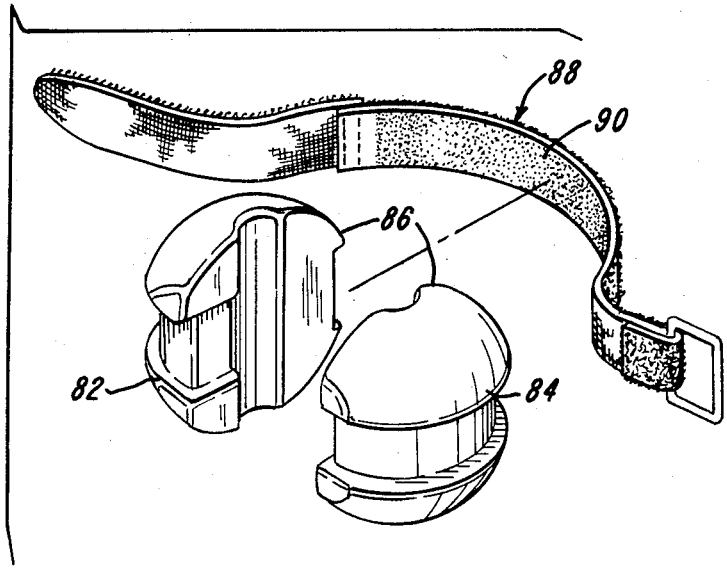
FIG. 9 is an exploded perspective view of the parts forming the weight of FIG. 7.

In the modification illustrated in FIGS. 7, 8, and 9, a weight 80 is provided having a pair of substantia11y identical jaws 82 and 84 that may be identical to the previously described jaws 24 and 26. The jaws 82 and 84 are provided with separate coatings 86 which may be formed from the same material used to produce the coating 60. In this case, the spring band 40 is omitted. Instead, a cinching strap 88 is adhered to the separately coated jaws 82 and 84 by an adhesive coating 90 that may be identical to the coating on the previously described strap 70. Indeed, the strap 88 could be the same in all respects as the strap 70. As apparent, the weight 80 can be used in the same manner as the weight 22. It has the advantage of being slightly cheaper to manufacture since the spring 40 is omitted. However, the weight 22 is presently preferred because it is somewhat easier to handle and may be more resistant to damage because the jaws are more securely held together.

Although the presently preferred embodiments of this invention have been described, it will be understood that various changes may be made within the scope of the appended claims.

Having thus described my invention, I claim:

1. A unitary golf club weight which is self-contained so that it does not require assembly or disassembly of component parts for use comprising a pair of substantially identical clamp jaws made from high specific gravity metal, each of said clamp jaws being formed as a generally hemispherical sector and having a generally planar surface with a shaft-receiving groove extending axially completely from the top to the bottom thereof and having an arcuate contour for engaging a golf club shaft which may be either straight or tapered, an elastomeric material coating at least said planar surface of each of said jaws and including the entire length of said grooves, and flexible clamp means connected to and extending around the girth of said jaws for holding said jaws together along adjacent side edges of said jaws and engaged with a golf club shaft along any part of the lenght thereof with said generally planar surfaces and aid grooves confronting one another, said clamp means comprising a cinch strap extending around said jaws substantially centrally between the tops and bottoms thereof by which the opposite side edges of said jaws maybe brought toward one another with said grooves engaging said golf club shaft, said adjacent edges of said jaws being so contoured that said jaws may move with respect to one another as said cinch strap is drawn tight so that said jaws are drawn into clamping engagement with said shaft along the entire length of said grooves.

2. The device of claim 1 wherein said strap includes a cinch ring and a hook and looped pile fabric fastener.

3. The device of claim 1 wherein said clamp means further comprises a band of spring steel extending around the outer surfaces of said jaws and constructed to hold said opposite edges of said jaws spread apart to form a slot between said jaws opening to said grooves.

4. The device of claim 3 wherein said strap includes a cinch ring and a hook and looped pile fabric fastener.

5. The device of claim 3 wherein said jaws and said spring steel band are completely covered by said elastomeric material and said cinch strap is adhesively secured to said elastomeric material.

6. The device of claim 5 wherein the outer surface of each of said clamp jaws has a centrally located, peripherally extending recess for receiving portions of said cinch strap intermediate its ends.

7. The device of claim 6 wherein said strap includes a cinch ring and a hook and looped pile fabric fastener.

8. The device of claim 1 wherein each of said clamp jaws is completely enclosed within said elastomeric material and said cinch strap is adhesively secured to said elastomeric material.

9. The device of claim 8 wherein the outer surface of each of said clamp jaws has a centrally located, peripherally extending recess for receiving portions of said cinch strap intermediate its ends.

10. The device of claim 9 wherein said strap includes a cinch ring and a hook and looped pile fabric fastener.

* * * * *